United States Patent [19]

Willcox

[11] Patent Number: 4,486,107

[45] Date of Patent: Dec. 4, 1984

[54] RIBBON GUIDING AND DIRECTING STRUCTURE AND CARTRIDGE

[76] Inventor: Frederick P. Willcox, 565 Oenoke Ridge, New Canaan, Conn. 06840

[21] Appl. No.: 422,924

[22] Filed: Sep. 24, 1982

[51] Int. Cl.[3] ..... B41J 32/00

[52] U.S. Cl. ..... 400/208; 400/228; 400/248

[58] Field of Search ..... 400/194, 195, 196, 196.1, 400/207, 208, 208.1, 228, 248

[56] References Cited

U.S. PATENT DOCUMENTS

| | | | |
|---|---|---|---|
| 2,074,778 | 3/1937 | Decker | 400/248 X |
| 4,047,607 | 9/1977 | Willcox | 400/208 |
| 4,047,608 | 9/1977 | Willcox | 400/208 |
| 4,203,676 | 5/1980 | Hatsell | 400/248 X |
| 4,277,187 | 7/1981 | Rello | 400/248 |
| 4,284,364 | 8/1981 | Rello | 400/248 X |
| 4,339,211 | 7/1982 | Alexander et al. | 400/248 |

*Primary Examiner*—Ernest T. Wright, Jr.
*Attorney, Agent, or Firm*—William D. Hall

[57] ABSTRACT

A frame-supported disposable ribbon supply and take-up cartridge for typewriters and printers of the type employing a carriage-transported printing device is equipped with a constant path length ribbon guiding and directing structure which can be collapsed and folded for compact packaging and which can also be factory pre-threaded to eliminate any need for the operator to fit a ribbon leader around any guides on the print carriage. One form of the invention uses twin one-way articulated ribbon guides which are connected by a ribbon directing bar and are each orthogonally pivoted to the sides of the cartridge for collapsing, rotating, and folding against the sides of the cartridge. The other form uses a single two-way articulated ribbon-guiding structure pivoted to the cartridge and having a second articulated structure, all of which can be folded against the sides of the cartridge.

14 Claims, 11 Drawing Figures

RIBBON GUIDING AND DIRECTING STRUCTURE AND CARTRIDGE

BACKGROUND OF THE INVENTION

1. Field of the Invention

This invention pertains to typewriters and printer ribbon guidance mechanisms and structures and to ribbon cartridges.

2. Description of the Prior Art

Many forms of factory pre-threaded ribbon cartridges for installation on the travelling print carriage of a typewriter or printer are shown in the prior art but the means employed are not generally applicable to articulated or compliant ribbon-guiding structures of the types shown in my U.S. Pat. Nos. 4,047,607 and 4,047,608 which are incorporated herein by reference. U.S. Pat. Nos. 4,277,187 and 4,284,364 show the application of a spreader bar or bridge to the outer ends of two flexible ribbon-guiding members to maintain a fixed separation and to provide a means of attachment to the print carriage. An early application of one type of spreader bar is shown in U.S. Pat. No. 2,074,778 to locate two loops of ribbon. A structure having a spreader bar attached to the outer ends of two flexible or compliant ribbon guides is not collapsible or foldable to any useful degree and hence requires an additional inordinate amount of packaging space or volume over requirements for the cartridge itself.

SUMMARY OF THE INVENTION

This invention provides two forms of collapsible and foldable ribbon guiding and directing structures which can be applied to disposable ribbon cartridges. The structures can be factory pre-threaded. In both forms the articulated ribbon guiding and associated ribbon directing structures are folded against the sides of the ribbon supply and take-up cartridge for very compact packaging. Further, the pre-threaded structures are designed for easy installation by the printer operator without having to thread or otherwise manually position the ribbon web on the print carriage.

DESCRIPTION OF THE PREFERRED EMBODIMENTS

Figures 1, 1A, 2, 3:
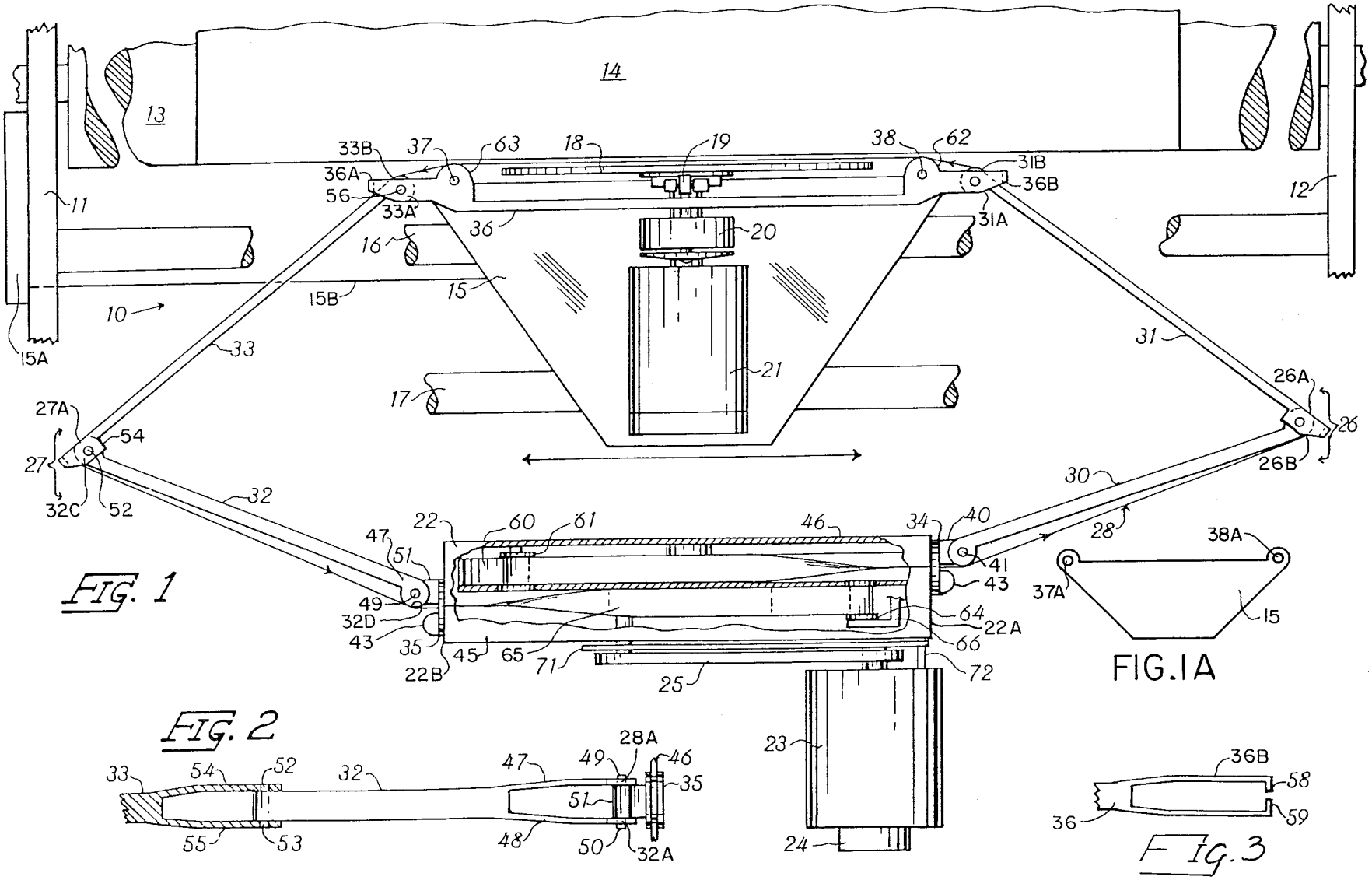
FIG. 1 is a schematic plan view of a printer incorporating a replaceable, frame-supported, ribbon cartridge having twin one-way articulated ribbon guides pivoted to the sides of the cartridge and fitted with a ribbon directing spreader bar.
FIG. 1A is a top view of a printing apparatus carriage.
FIG. 2 is a side elevation of the left articulated ribbon guide showing the straddle link and integral pin structure.
FIG. 3 is a partial elevation detail of the ribbon guiding structures showing the ribbon retention lugs.

Referring to FIG. 1 of the drawing, a printer is generally indicated by the reference number 10. The left and right side members of the machine frame are indicated at 11 and 12 respectively. The platen 13, journalled in side members 11 and 12, supports a record medium 14. A printing apparatus carriage 15 moves back and forth along the writing line on guide rods 16 and 17 and is positioned and is moved back and forth by any conventional mechanism such as stepping motor 15A actuating through cable 15B. Carriage 15 supports a daisy type print wheel 18, a print hammer 19, an electromagnet 20 for driving the print hammer 19, and a character selection servo or stepping motor 21, as well as other mechanisms as required.

A ribbon supply and take-up cartridge containing co-axially supported ribbon supply and take-up rolls 60, 65 is generally designated by the number 22. A ribbon take-up stepping motor 23 is supported by a frame member 24 and drives a take-up roll 65 through a cogged belt 25. Cartridge 22 supports twin, generally identical articulated ribbon guides generally indicated at 26 and 27, each guiding the ribbon 28 in one direction. The right articulated guide 26, here used for guiding the out-going ribbon 28 from the cartridge 22 to the carriage 15, has a primary arm 30 and a secondary arm 31. The left articulated guide 27, here used for guiding used ribbon 28 from the carriage 15 back to the cartridge 22, also has a primary arm 32 and a secondary arm 33.

The primary arms 30 and 32 are each supported at one end for limited rotation in first and second planes which are perpendicular to each other. The arms 30 and 32 are mounted on pivot blocks 34 and 35, respectively, which are free to rotate in, and retained by, the respective side walls 22A and 22B of the two case halves 45 and 46 of cartridge 22. The secondary arms 31 and 33 are hinged, at respective elbow joints 26A and 27A, to their respective primary arms 30 and 32. The outer ends of the secondary arms 31 and 33 are hinged to a spreader bar 36 by pivot connections 31A and 33A respectively. Pivot connections 31A and 33A are contructed in a manner similar to elbows or articulated ribbon guides 26 and 27 and serve as the ribbon directing means on carriage 15 to guide the ribbon 28 between the print wheel 18 and the record medium 14. The spreader bar 36 is removably retained on carriage 15 by support pins 37 and 38 which project upward from carriage 15. These two pins, 37 and 38, could just as easily be integrally formed on bar 36 and project from the bottom of the bar 36 for retention in respective holes 37A and 38A (see FIG. 1A) in carriage 15.

The twin articulated ribbon guides 26 and 27, spreader bar 36, and pivot blocks 34 and 35 are shown as solid members which would be molded of a suitable low friction plastic material. The articulated ribbon guides 26 and 27, and bar 36 could also be made up of metal links as shown in my referenced U.S. Pat. No. 4,047,607.

Figure 5:
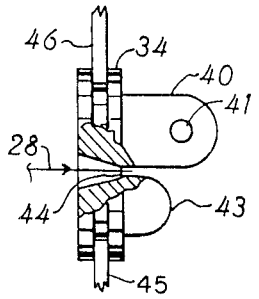
FIG. 5 is a partially sectioned side view of one of the rotary articulated guide pivot blocks.
Figure 6:
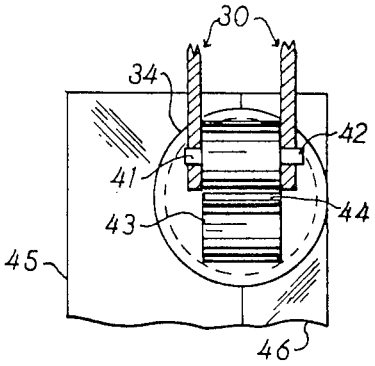
FIG. 6 is an end view of the rotary pivot block shown in FIG. 5.

Referring now to FIGS. 5 and 6, pivot block 34 is shown in detail. Pivot block 35 is identical in construction. An integral shoulder support 40 has integrally molded pins 41 and 42 which support primary arm 30. Block 34 also has a ribbon guide projection 43 for supporting the ribbon 28 when the twin articulated ribbon guides 26 and 27 are folded as to be later described. Pivot block 34 also has a rectangular slot 44 for the ribbon 28 to pass through. As shown, block 34 is held captive between the two halves 45 and 46 of the cartridge 22 case.

FIG. 2 shows further details as to how the primary and secondary arms 32 and 33 are constructed. Primary arm 32 has two straddle links 47 and 48 with pivot holes 28A and 32A which snap over pins 49 and 50 respectively which are integral with shoulder support 51 on pivot block 35, (shown in FIGS. 1 and 4). The other end of arm 32 has integral pins 52 and 53 which engage the respective straddle links 54 and 55 of the secondary arm 33. The outer end of arm 33 has integral pin 56 (shown in FIGS. 1 and 4), which engages straddle links 36A at the left end of spreader bar 36. Primary arm 30 and secondary arm 31 are constructed in a like manner and the outer end of arm 31 engages straddle links 36B at the right end of bar 36. FIG. 3 shows the detail of the straddle link ends of arms 31 and 33, and of spreader bar 36, and shows the bent-over ends or lugs 58 and 59. The ends of lugs 58 and 59 are slightly separated to permit threading of the ribbon 28 and also serve to keep the ribbon 28 in place when there is no tension on the ribbon 28.

Referring back to FIG. 1, the ribbon 28, here assumed to be of the single-strike or multi-strike carbon variety, comes off the ribbon supply roll 60, passes over stripper roller 61, makes a ninety degree twist before passing through slot 44 in pivot block 34, partially around shoulder support 40 and thence to the elbow joint 26A where secondary arm 31 is hinged to the end of primary arm 30. The ribbon 28 then goes partially around a portion of outer curved surface 26B of elbow joint 26A at the end of primary arm 30 and along the the outer surface of secondary arm 31, partially around a curved surface 31B of pivot connection 31A at the outer end of arm 31, over curved blocks 62 and 63 on spreader bar 36, thence partially around curved surface 33B of pivot connection 33A thence along the surface of arm 33, partially around the radius 32C on the end of primary arm 32, and then partially around the radius 32D and into the cartridge 22, makes another ninety degree twist, passes around take-up roller 64, and on to the take-up roll 65, (see FIG. 4). Roller 64 is supported by bracket 66 which projects from the inside of case half 46.

Figure 4:
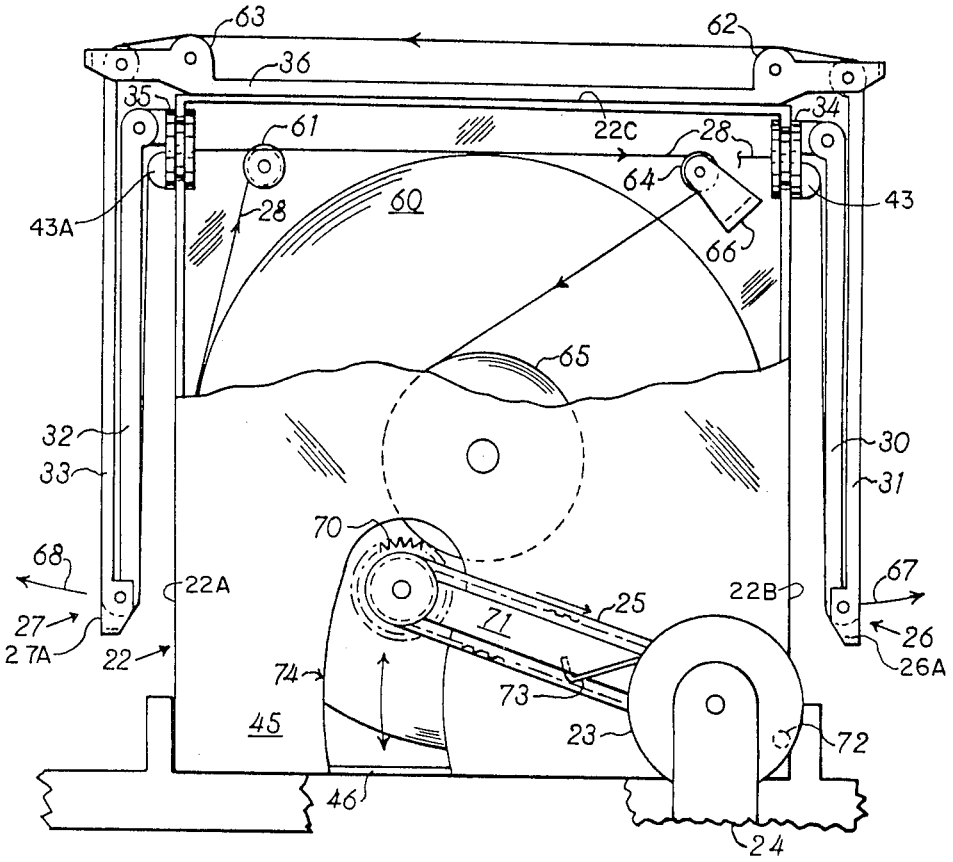
FIG. 4 is a front elevation view of the ribbon cartridge of FIG. 1 with the twin articulated ribbon guides and spreader bar collapsed and folded for packaging.

FIG. 4 shows how the cartridge 22, generally constructed of low friction plastics permitting flexibility in thin sections, is supported by frame member 24 and engages the take-up mechanism 64 and 65. The twin articulated ribbon guides 26 and 27 are shown rotated and folded against the sides 22A and 22B of cartridge 22 with the attached spreader bar 36 against the top 22C of the cartridge 22. This folded and collapsed position of the articulated guides 26 and 27 and spreader bar 36 is the position used for packaging the cartridge 22 and, as can be seen, requires little additional packaging space over that required for just the cartridge 22. Before or after the ribbon cartridge 22 is installed in printer 10, the elbow joints 26A, 27A of articulated guides 26 and 27 are swung outward in the direction of their respective arrows 67 and 68. This raises the spreader bar 36 away from the cartridge 22 and then the guides 26 and 27 can be rotated into position for attaching the spreader bar 36 to the carriage 15. FIG. 4 also shows the use of the ribbon guide projection 43 on pivot block 34 and projection 43A on pivot block 35.

The ribbon supply and take-up rolls 60 and 65 respectively can be clearly seen in FIG. 4 as can the path of the ribbon 28 leaving the supply roll 60 and from take-up roller 64 and onto the take-up roll 65. The take-up mechanism is basically comprised of a stepping motor 23, supported by frame member 24, which drives a spiked wheel 70 supported on the end of a swinging lever 71 by means of the cogged belt 25. The upward rotation of lever 71 is limited by a stop pin 72, (more clearly seen in FIG. 1). Upward rotation of lever 71 is provided by spring 73. As the take-up roll 65 becomes larger, the spiked wheel 70 and lever 71 move downward. The front half 45 of the cartridge 22 has notch 74 formed therein so that cartridge 22 passes over spiked wheel 70 when it is inserted into position in printer 10.

Figures 7, 7A, 8, 9:
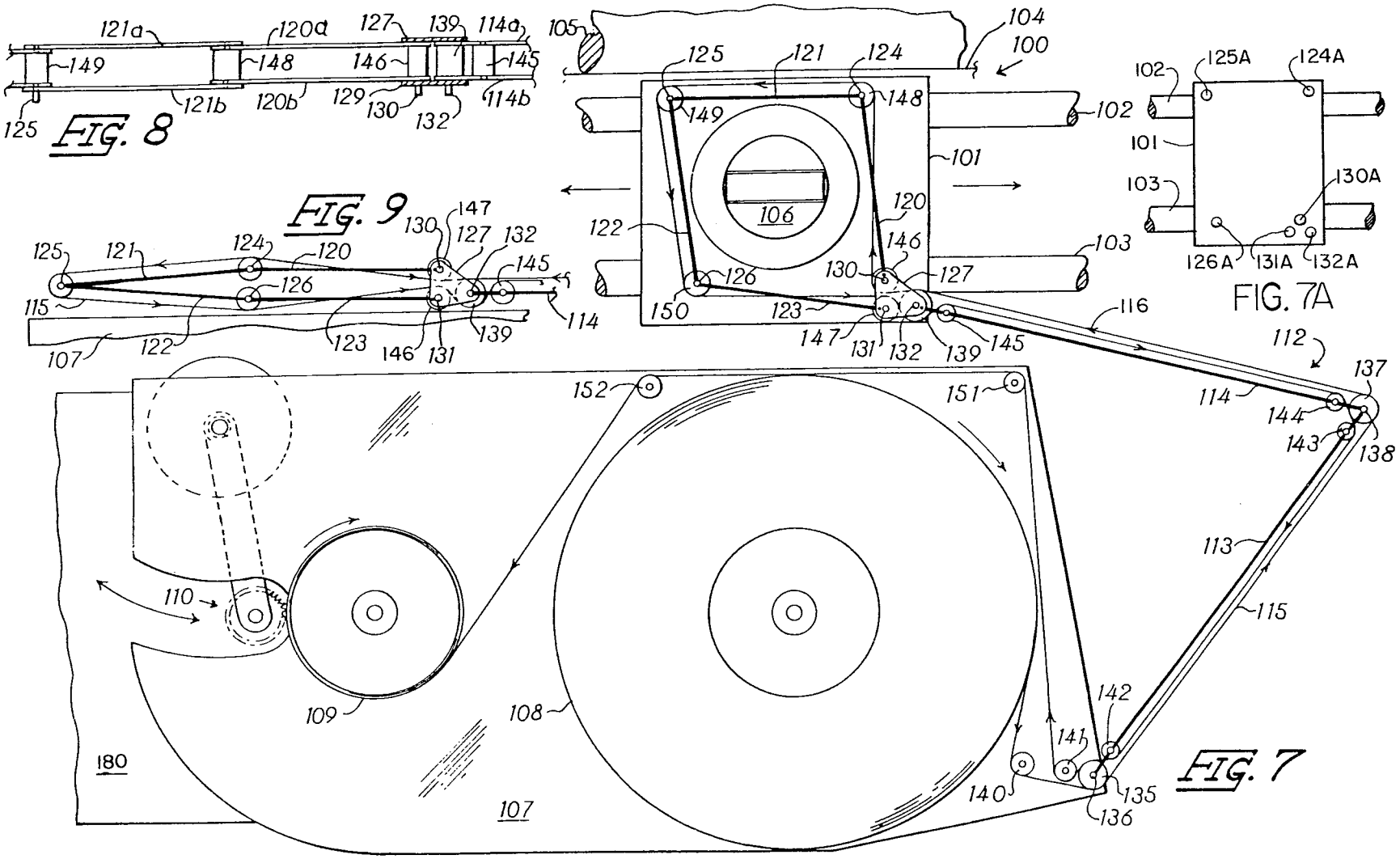
FIG. 7 is a schematic plan view of a printer using a different ribbon cartridge and articulated ribbon-guiding structure with an articulated folding ribbon directing structure in lieu of a spreader bar.
FIG. 7A is a top view of the print carriage.
FIG. 8 is a partial elevation view of the articulated ribbon directing structure.
FIG. 9 shows how the articulated ribbon directing structure is folded for packaging.

FIG. 7 shows a printer 100 having a movable print carriage 101 slidable along guide bars 102 and 103 for making a line of imprints on a record material 104 supported by a platen 105. Carriage 101 supports a printing element 106 which may be of any type such as that known as a "golf ball" or that prints with individual type chips. Printer 100 is shown here employing a ribbon cartridge 107 supported on printer frame 180. This cartridge 107 is of the type shown in my previously referenced U.S. Pat. No. 4,047,607 but may be of the type employing a metal band for guiding the ribbon as shown in my other referenced U.S. Pat. No. 4,047,608.

Cartridge 107 has a ribbon supply roll 108, a ribbon take-up roll 109, and a take-up mechanism generally designated by the number 110 which may be of the type shown in FIGS. 1 and 4. Pivotally attached to cartridge 107 is an articulated ribbon-guiding structure generally designated by the number 112 having links 113 and 114 for supporting rollers 135, 137, 145 which guide a ribbon 115 from the cartridge 107 to the ribbon directing assembly 139, 146, 148, 149, 150 and 147 on carriage 101 and then back to cartridge 107 for take-up. The ribbon 115 moves along its path in the direction indicated by the various arrowheads placed along the path such as the arrowhead 116.

The foldable ribbon directing assembly 139, 146, 148, 149, 150 and 147, shown in elevation in FIG. 8 and folded in FIG. 9, has articulated links 120, 121 122, and 123 which are hinged together in sequence by pins 124, 125, and 126, and are pivoted between triangular plates 127 and 129 by pins 130 and 131. Triangular plates 127 and 129 are, in turn, pivoted to articulated link 114 by pin 132. As can be seen in FIG. 8, pins 125, 130, and 132 extend downward from their respective linkages 149, 146 and 139 and are placed in their respective holes 124A, 125A, 126A, 130A, 131A and 132A (see FIG. 7A); on carriage 101 to hold the ribbon directing assembly in place after it is installed in printer 100 along with cartridge 107. The outer end of articulated link 114 pivots around pin 132 as the carriage 101 moves back and forth along the guide bars 102 and 103.

For sake of clarity in the schematic views of FIGS. 7 and 9, the various articulated links 113, 114, 121, 122, 123, and 124 are shown as a heavy solid line. They may be constructed as shown in my referenced U.S. Pat. No. 4,047,607 and as shown in FIG. 8 where each link 114, 120, 121 has separate link bars **114*a*, 114*b*, 120*a*, 120*b*, 121*a*, and 121*b*. Thus link 120 is comprised of link bars 120*a* and 120*b*, link 121 of bars 121*a* and 121*b*, and link 114 of bars 114*a* and 114*b*. The articulated ribbon guiding structure has three primary rollers 135, 137, 139. Primary roller 135 is positioned on pivot pin 136 which attaches link 113 to cartridge 107. Primary roller 137 rotates on hinge pin 138 which joins like 113 and 114. Primary roller 139 rotates on pivot attachment pin 132. Supplementary ribbon guiding rollers 140 and 141 supported in cartridge 107, 142 and 143 supported by link 113, 144 and 145 supported by link 114, and 146 and 147 supported between triangular plates 127 and 129, all serve to hold the ribbon 115 in contact with primary rollers 135, 137, and 139 as the carriage 101 moves back and forth along the writing line so as to effectively maintain a constant or practically constant ribbon path length from the cartridge 107 to the carriage 101 and back to the cartridge 107 as the carriage 101 is moved. As in FIG. 1, where the ribbon 28 passes around various radii, if these various radii as well as the diameters of the primary rollers 135, 137, and 139** are, respectively, kept equal, then the ribbon path length is generally constant.

Referring again to FIG. 7, The ribbon 115 leaves supply roll 108, passes around secondary roller 140, over primary rollers 135, 137, and 139, around secondary roller 146, then around rollers 148, 149, and 150 which are supported by links 120, 121, 122, and 123, thence around secondary roller 147, over primary roller 139, around secondary rollers 144 and 145, over primary roller 137, around secondary rollers 142 and 143, over primary roller 139, around secondary roller 141, and thence to the take-up roll 109 passing over cartridge guide rollers 151 and 152 which guide ribbon 115 around the supply roll 108.

FIG. 9 shows how the articulated ribbon directing linkage assembly folds against cartridge 107 for packaging where it may be retained by a clip if desired. The articulated ribbon guiding link 113 folds against the right side of cartridge 107 and link 114 lays along the upper side on the cartridge 107 along with the ribbon directing linkage 120–132 as shown.

The ribbon directing linkage or assembly 120–132 as shown in FIGS. 7, 8, and 9 can also be applied to the compliant ribbon-guiding structure shown and described in my referenced U.S. Pat. No. 4,047,608.

While the cartridge 22 as shown in FIGS. 1 and 4 is installed in a vertical position, this is not a limiting requirement. Indeed, it can be installed, for example, to lay at an angle under the printer keyboard which is tilted forward for access for removal and replacement of cartridge 107.

While the invention has been particularly shown and described with reference to the preferred embodiments thereof, it will be understood by those skilled in the art that various changes in form and detail and in applying the concepts of the invention may be made without departing from the spirit or scope thereof.

I claim:

1. A ribbon cartridge assembly, having a case containing ribbon, for use in a printer of a kind having (a) stationary means for receiving said case, and (b) a carriage which is movable with respect to said stationary means along a printing path, said carriage including printing means, comprising:

(a) ribbon guiding means supported by and extending away from said case for guiding the ribbon leaving the case, said ribbon guiding means having first and second ends, said first end being connected to the case, and (b) ribbon directing means for attachment to and detachment from said carriage, said ribbon directing means being connected to said second end and comprising an expandable and collapsible linkage, which when expanded may be attached to said carriage to guide said ribbon from said ribbon guiding means onto said carriage and around and past said printing means, (c) said ribbon directing means being collapsible to minimize the space required for packaging.

2. An assembly as defined in claim 1 wherein:

said ribbon directing means comprises collapsible articulated means which, with said ribbon guiding means, can be collapsed and closely folded against said case for the compact packaging of said assembly.

3. An assembly as defined in claim 2 wherein:

said case contains take-up means for used ribbon, said printer has means for engaging said take-up means and effecting take-up of said used ribbon, and said articulated means supports and guides said used ribbon along a path from said ribbon directing means to said case for take-up therein.

4. A ribbon cartridge for use in a printer of the kind having (a) a frame with means thereon for receiving said cartridge, and (b) a carriage which is movable with respect to said frame along a printing path, said carriage including printing means on the carriage, said ribbon cartridge having a case with first, second and third walls each of which walls is perpendicular to the other two:

a supply of ribbon in said case, said cartridge including: (i) ribbon-directing means for directing said ribbon around and past said printing means, and (ii) ribbon-guiding means for supporting and guiding ribbon along a path between said case and said ribbon-directing means, said ribbon-guiding means having two ends, one of which ends is supported by said case and the other of which ends is connected to said ribbon-directing means, said ribbon-guiding means, when the cartridge is in actual use, extending from a position adjacent to said first wall of said case, and away from said first wall and to the ribbon-directing means, and means enabling said ribbon-directing means to be readily attached to and detached from said carriage, said ribbon-guiding means being rotatable, about an axis passing through said case and parallel to the path of travel of said carriage, to thereby permit said ribbon-guiding means to be moved to a position closely adjacent said second wall of said case in which event the ribbon-directing means is moved to a position closely adjacent said third wall of said case.

5. A ribbon cartridge according to claim 4 in which said ribbon-guiding means comprises two links, and includes roller means associated with said links for guiding said ribbon from said case to said ribbon-directing means.

6. A ribbon carriage according to claim 4 further comprising a ribbon take-up means in said case, said ribbon-guiding means guiding unused ribbon from the case to said ribbon-directing means and guiding used ribbon from the ribbon-directing means to said ribbon take-up means, and driving means in fixed relation to said stationary means for driving said ribbon take-up means.

7. A ribbon cartridge for use in a printing machine which machine has (a) stationary means for receiving said cartridge, and (b) a printing carriage movable with respect to said stationary means along a printing path, said printing carriage comprising printing means, comprising:

(a) ribbon-directing means for directing ribbon past said printing means, (b) means cooperating with said ribbon-directing means and said carriage for detachably holding said ribbon-direction means on said carriage, (c) a casing including means to enable the casing to be supported by said stationary means, (d) ribbon supply means in said casing for storing a supply of ribbon, and (e) ribbon-guiding means connected to said casing and to said ribbon-directing means, to guide the ribbon from said ribbon supply means to said ribbon-directing means, (f) said ribbon-guiding means including means for guiding said ribbon from said ribbon supply means to said ribbon-directing means along a path of substantially unvarying length irrespective of the position of the printing carriage along its printing path, said ribbon-guiding means comprising linkage means having first and second links, each of said links having first and second ends, the first end of the first link being pivoted to said casing, the second end of the first link being pivoted to the first end of the second link, the second end of the second link being pivoted to said ribbon-directing means, (g) said ribbon-directing means including at least two links that are collapsible into an elongated configuration, (h) said ribbon-guiding means and said casing being so configured that when the cartridge is not in use the ribbon-guiding means may be moved to a position wherein it lies closely adjacent to the casing with the collapsed ribbon-guiding means also being closely adjacent to said casing.

8. A ribbon cartridge as defined in claim 7 in which the outer walls of the casing are so configured that the ribbon-guiding means and the collapsed ribbon-directing means may be moved to positions closely adjacent to at least one of said outer walls, to provide a compact arrangement of the cartridge.

9. A ribbon cartridge as defined in claim 7 in which said pivoting of said first end of said first link to said casing is for supporting said ribbon-guiding means for rotation about an axis parallel to the path of travel of said carriage, so that the ribbon-guiding means may be rotated to a position wherein said ribbon-guiding means lies adjacent said casing, thereby to provide a compact structure when the cartridge is not in use.

10. A ribbon cartridge assembly having a case containing a supply of ribbon and take-up means for the ribbon, for use in a printing machine of the kind having (a) a frame with respective means thereon for receiving said cartridge assembly and for engaging said take-up means and effecting take-up of said ribbon, and (b) a carriage movable with respect to said frame along a printing path, said carriage including printing means on the carriage, the improvement comprising:

(a) ribbon-directing means including means for attachment to and detachment from said carriage, for directing said ribbon around and past said printing means;

(b) a first articulated ribbon-guiding means having two links, each such link having first and second ends, the first end of the first link being supported by said case and the second end of the first link being pivotally connected to the first end of the second link, the second end of the second link being pivotally connected to said ribbon-directing means (c) a second articulated ribbon-guiding means having two links, each such link having first and second ends, the first end of the first link being supported by said case and the second end of the first link being pivotally connected to the first end of the second link, the second end of the second link being pivotally connected to said ribbon-directing means, (d) said first articulated ribbon-guiding means comprising means for guiding said ribbon from the case to the ribbon-directing means, and said second articulated ribbon-guiding means comprising means for guiding the ribbon from the ribbon-directing means back to the case, (e) first and second pivot means on the case for respectively supporting said first ends of said first links, (f) said first and second ribbon-guiding means being arranged to fold in opposite directions, (g) said ribbon-directing means comprising a link-like structure having two end portions opposite each other pivotally attached to the respective said second ends of said first and second ribbon-guiding means, where said ribbon-directing means, said first and second ribbon-guiding means and said first and second pivot means all being so arranged and disposed in relation to said case that the ribbon-directing means and the first and second ribbon-guiding means can be collapsed and closely folded against said case for compact packaging of said assembly.

11. A ribbon cartridge assembly as defined in claim 10 in which said first and second pivot means support said first and second articulated ribbon-guiding means respectively for rotation about an axis that passes through said case and is parallel to the path of travel of said carriage, said first and said second pivot means each having slots therethrough to provide passageways for the ribbon.

12. A ribbon cartridge assembly as defined in claim 10 in which said case has opposing sidewalls, and said first pivot means and said second pivot means are respectively mounted on said opposing sidewalls; with a common axis of rotation, for the first and second pivot means, which passes through the case and is parallel to the path of travel of said carriage.

13. A ribbon cartridge assembly as defined in claim 10 in which said case comprises two shallow pan-like mating halves which retain said supply of ribbon and said take-up means, said case having opposing sidewalls, said first pivot means and said second pivot means being respectively mounted on said opposing sidewalls, said mating halves mating together along said opposing sidewalls, at least one of said pivot means being supported between said two mating halves.

14. An assembly as defined in claim 10 wherein:

said ribbon-directing means comprises a link-like structure having two end portions opposite each other and pivotally attached to the respective said second ends of the first and second ribbon-guiding means.

* * * * *